US005685174A

United States Patent [19]

Balzer et al.

[11] Patent Number: 5,685,174

[45] Date of Patent: Nov. 11, 1997

[54] DECORATIVE CONNECTOR AND METHOD FOR AFFIXING SAME

[76] Inventors: Sherri Kay Balzer, 1366 N. Morningside Dr., Atlanta, Ga. 30306; Katherine Lynn Overby, 93 De Arc Way, Atlanta, Ga. 30327

[21] Appl. No.: 599,949

[22] Filed: Feb. 14, 1996

Related U.S. Application Data

[63] Continuation-in-part of Ser. No. 492,769, Jun. 21, 1995, abandoned.

[51] Int. Cl.[6] ..... A44C 13/00

[52] U.S. Cl. ..... 63/29.1; 63/1.1; 24/578

[58] Field of Search ..... 63/2, 29.1, 1.1, 63/1.2; 24/578, 573.1

[56] References Cited

U.S. PATENT DOCUMENTS

| | | | |
|---|---|---|---|
| 1,641,917 | 9/1927 | Carr | 24/578 |
| 2,099,979 | 11/1937 | Bangs | 63/29.1 |
| 2,648,110 | 8/1953 | Baskind | 24/578 |
| 2,667,004 | 1/1954 | Sanson . | |
| 2,796,650 | 6/1957 | Van Buren | 63/29.1 |
| 3,088,295 | 5/1963 | Haines | 63/29.1 |
| 3,830,080 | 8/1974 | Friedlander . | |
| 3,831,398 | 8/1974 | Davis . | |
| 3,979,802 | 9/1976 | Bongartz | 24/578 |
| 4,783,974 | 11/1988 | Hernandez . | |
| 4,959,890 | 10/1990 | Pazurek . | |
| 5,355,698 | 10/1994 | Edmark . | |

*Primary Examiner*—Flemming Saether
*Attorney, Agent, or Firm*—Morris, Manning & Martin L.L.P.

[57] ABSTRACT

A decorative connector for affixing to a clothing burr and a method for affixing such connector is disclosed. In one form, the connector comprises a decorative element and coupler means fixed to the element. The coupler means is adapted for detachable securement to the burr. In another form, the coupler means is mounted on the burr and is adapted to engage and detachably secure the decorative connector. When the connector is detached, the coupler means remains mounted on the burr ready to receive another decorative connector. The method for affixing the decorative connector comprises mounting coupler means to a burr and attaching the connector to the coupler means.

7 Claims, 2 Drawing Sheets

DECORATIVE CONNECTOR AND METHOD FOR AFFIXING SAME

CROSS REFERENCE

The present invention is a continuation-in-part of application Ser. No. 08/491,769, filed Jun. 21, 1995, entitled "A DECORATIVE CONNECTOR," by inventors Sherri K. Balzer and Katherine L. Overby now abandoned. The application is incorporated herein by reference.

BACKGROUND OF THE INVENTION

The present invention relates generally to decorative connectors, and more particularly to detachable decorative connectors and a method for affixing such connectors to an article of clothing.

The need for accessories, decoration and fashion items is ever increasing in today's marketplace. The desire for self-expression is constantly growing because there are so many ideas and causes about which people want to make a statement. This includes personal attitudes and beliefs as well as corporate and brand identity. Attitude T-shirts have come to display these ideas, beliefs and causes as a big volume segment of the retail industry. This need for self expression has transpired into such forms as very popular lapel pins which are now worn all over the body, and in extreme cases this expression has led to body piercing and tattoos. Under these avenues, one must wear an entire piece of apparel, possible damage their apparel or permanently scar their bodies.

By offering the application of the decorative connector, the restrictions outlined above no longer apply. We can now offer an alternative method of displaying beliefs and attitudes. Possibility of a variety and multitude or ornamentation is readily available through this application which is versatile and interchangeable. The decorative connector also offers an opportunity to display a variety of beliefs and attitudes and can be executed via multiple burrs on various apparel.

SUMMARY OF THE INVENTION

In compliance with the aforementioned invention, decorative ornaments are applied to a connector which attaches to an existing burr found on apparel. In one form, these ornaments are permanently attached to the connector which is then placed on the burr existing on the garment. Based on this concept, this decorative connector is easily removed and replaced with other decorative connectors, or can be worn in conjunction with other connectors with decorations depending on the number of burrs available. This provides a means of safely decorating one's apparel as well as being easily attached on a temporary basis. Because of the ease of changing the accessory, one is able to alter the appearance and attitude of an existing outfit. This is an inexpensive way to alter appearance and display different forms of self-expression.

Prior to this invention, there has not been an application to decorate burrs found on apparel. This form is much safer than pins because the user is not in danger of puncturing themselves or damaging their garments. This also offers a safe alternative of displaying personal attitudes or beliefs. In the past, people have used tattoos and body piercing to achieve the same result. Overall, the present invention offers an accessory that is lightweight, easily applied, removed and replaced, as well as being cost effective.

In a preferred form of the present invention, the decorative connector for affixing to a clothing burr comprises a decorative element and coupler means fixed to the element. The coupler means is adapted for detachable securement to the burr. Preferably, it has an inner element with a female member for receiving a male member of the burr and an outer element with a male snap flange for securement to a snap ring of the decorative element. The inner and outer elements of the coupler means form a compound interface. Further, the male member of the burr extends outwardly from the clothing for securement in a recess of the female member of the inner element. The decorative element of the decorative connector can be any ornamental shape or design with or without text or any like items.

In another preferred form of the invention, an article of clothing for affixing the decorative connector comprises a burr fixed to the article of clothing and coupler means mounted on the burr. The coupler means is adapted to engage and detachably secure the decorative connector. When the decorative connector is detached, the coupler means remains mounted on the burr. In a further form, the burr has a male member extending outwardly for securing the coupler means. The coupler means has a female member with a recess for receiving the male member. Structurally, the coupler means comprises an inner element having a female member receiving the male member of the burr, and an outer element having a male snap flange for detachable securement to the decorative connector. The inner and outer elements of the coupler means form a compound interface. The male member of the burr has a neck extends outwardly from a base flange for securement in the recess of the female member. The decorative connector for attachment to the coupler means comprises a decorative element and engagement means adapted for securement to the coupler means mounted on the burr. Preferrably, the engagement means of the connector is a female snap ring adapted to fit with a male snap flange of the coupler means. Again, the decorative element can be any ornamental shape or design with or without text or like items.

The present invention also provides for a method for affixing a decorative connector to clothing. In a preferred form, this method comprises mounting coupler means to a burr, and attaching the decorative connector to the coupler means. The burr has an outwardly extending male member and the coupler means has a female member adapted to receive and secure the male member of the burr. The coupler means comprises an inner element having a female member with a recess for receiving a male member of the burr and an outer element having a male snap flange for detachable securement to the decorative connector. The inner and outer elements of a coupler means form a compound interface. The male member of the burr extends outwardly from a base flange for securement in a recess of the female member.

The decorative connector fixed to the burr of clothing comprises a decorative element, and engagement means attached to the decorative element adapted for securement to the coupler means. Preferrably, the engagement means is a female snap ring fitted for the male snap flange or ring of the coupler means.

BRIEF DESCRIPTION OF THE DRAWINGS

For a better understanding of the present invention and its advantages, refer to the following detailed description written in conjunction with the accompanying labeled drawings in which.

DETAILED DESCRIPTION OF THE INVENTION

Referring now to the accompanying drawing FIGS. 1 through 4 in which like reference numbers indicate like features throughout, the device 3 is the connector. This connector consists of two sections, a base which is disk shaped and a cap which is round in shape and is hollow to cover the burr. To better understand the structure of this device a description of a burr is needed. A burr is a functional notion used commonly on denim jeans. It is placed on seams that are subject to high stress. Burrs are found mainly around the pockets of jeans and other locations on various types of apparel. The burr is comprised of two pieces combined by a rivet process. The bottom piece of the burr is a disk shaped object which is very flat and has a small protrusion so it can go through fabric and connect to the top part of the burr. The top of the burr is also a flat disk shape and the center is raised and rounded so it can be riveted with force to the bottom piece. The term bull's eye has been used to describe the burr's appearance and it is about the size of a small button. This combination creates a conjunction between the fabrics being placed together. Burrs are most commonly made of materials such as steel, brass or aluminum and may have finishes like nickel, tin or copper. The burrs are represented in the figures and labeled 2. This drawing shows the most common placement of burrs found on apparel. Based on this understanding of a burr, a detailed description of the decorative connector follows.

Figure 1:
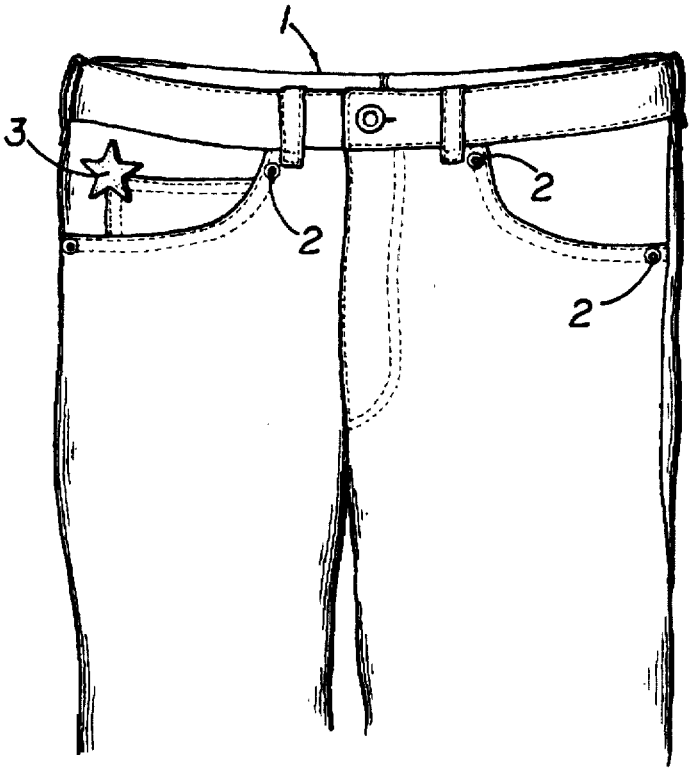
FIG. 1 is an enlarged view of a frontal perspective of a decorative connector attached to the existing burr on a garment shown with other available burrs designated by 2.

Referring to FIG. 1, an overall view of the invention and use is shown. This is obviously a pair of jeans, which represents any apparel, with the burrs labeled as 2 and the decorative connector invention denoted by 3. This represents the function of this accessory and, as pointed out, multiple decorative connectors may be worn on the various burrs present.

Figure 2:
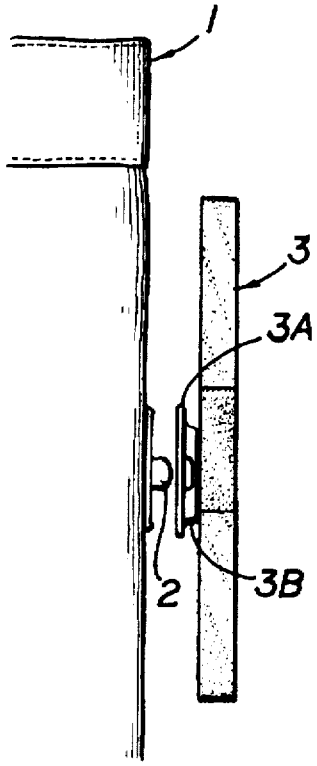
FIG. 2 is a side view of a decorative connector ready to attach to an existing burr.
Figure 3:
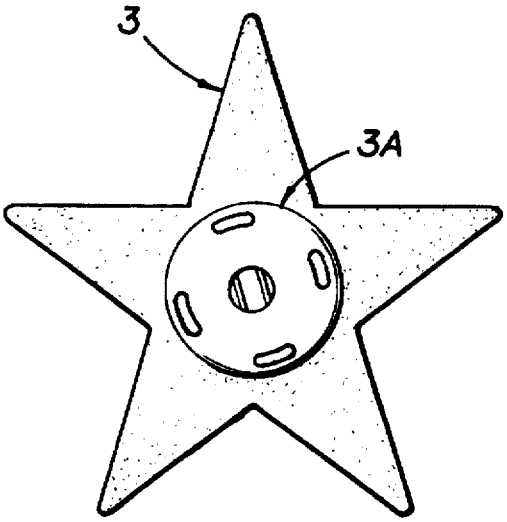
FIG. 3 is a rear view of the decorative connector shown in FIG. 2.
Figure 4:
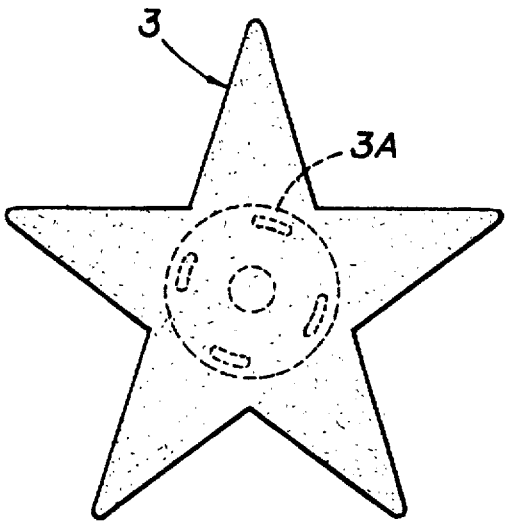
FIG. 4 is a frontal view allowing a transparent insight to a functional connector.

FIG. 2, which is a side view, contains an application of the invention on an existing burr 2 described earlier. The finished product is labeled 3 with detailed labels, on the functioning decorative connector. 3*a* represents the flat, disk shaped component referred to as a base, which will fit flush with the same shape found on the top section of the burr. The base can also be described as the rim section of the connector. This base will be the same size of the circumference of the burr and will be placed against this piece. 3*b* shows in detail the raised cavity section of the connector referred to as a cap. This is the space created to fit over the rounded object, or protrusion, found on the burr. This space in the cap of the connector will be formed to accept the male-like form of the burr. The combination of these two parts form the connector piece. As described, 3*a* will act as a base to fit flush against the flat base of the burr, while 3*b* is the cap functioning as a female section to accept the raised male portion of the burr. The ability of combining the connector with the existing burr creates an application, which as claimed in the present invention is an ideal form to be decorated and used as a form of self expression.

The device can be of any material most preferably metal, plastic or rubber. The device will connect to burr 2, and as shown in detail in FIG. 2, the raised section of the burr will be received by the cap section of the connector 3*b* with the base of the connector 3*a* coming into contact with the base of the burr forming a closure.

Figure 5:
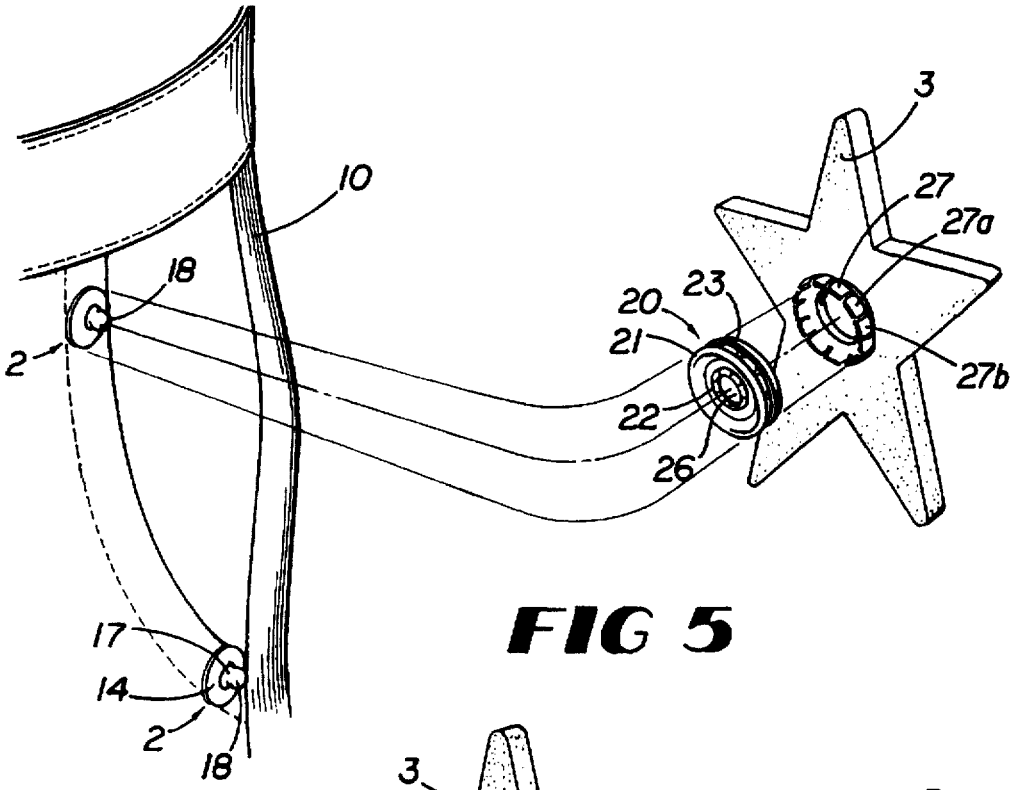
FIG. 5 is a perspective view of an embodiment of the present invention illustrating a detached decorative connector, its associated coupler means and the burr location where the connector is attached.

Referring more particularly to FIG. 5, an article of clothing shown generally at 10, preferably jeans, is shown having burrs generally at 2. The burrs are located at the pocket seams of article 10, an area subject to high stress due to the constant application of force as a person inserts or withdraws objects from the pocket. Burr 2 has a structure comprising a base flange 14 and a male member 16 having a neck 17 and snap head 18. Each burr is secured to the article of clothing by a known rivet process. Further, each burr of the present invention is preferably made of steel, brass, or aluminum having an esthetically pleasing finish such as nickel, tin, copper, or any other metallic substance. Referring still to FIG. 5, a preferred embodiment of the present invention shown at 3 is adapted to fit coupler means shown generally at 20 and be secured to the burr 2 of clothing 10. Coupler means 20 comprises an inner snap element 21 with a female member 22 having a recess 26 for receiving and securing the male portion 16 of burr 2. The coupler means 20 also has an outer snap element 23 comprising a male snap ring 24 for securement to the decorative connector 3. The inner element 21 and outer element 23 of coupler means 20 combine to form a compound snap interface. The decorative connector 3 includes a female snap ring 27 for receiving and securing the male snap ring 24 of coupler means 20. The female snap ring 27 includes radial spring-type gripper segments referred to at 27*a* and 27*b* as examples. The female snap ring of decorative connector 3 may be fixed to the decorative connector by adhesives, mechanical fastening means or may be integral to the connector itself.

Figure 6:
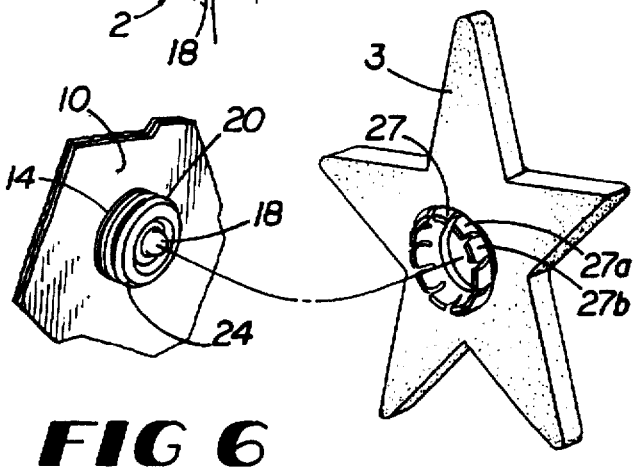
FIG. 6 is a perspective view of an embodiment of the present invention illustrating a detached decorative connector and an article of clothing having a coupler means attached to a burr of the clothing.

FIG. 6 illustrates another preferred embodiment of the present invention. The decorative connector 3 is shown having female snap ring 27 with the associated radial spring-type gripper segments 27*a* and 27*b*. Also shown is clothing portion 10 having fixed thereto a burr 2, of which snap head 18 is shown protruding through coupler means 20. The female snap ring 27 of decorative connector 3 is adapted to secure over coupler means 20 by engaging and securing over a male snap ting 24. Coupler means 20 is fixed to the burr of clothing 10 whereby upon detaching and removing decorative connector 3, coupler means 20 remains fixed to the burr. This embodiment also illustrates a significant feature of the present invention. That is, various decorative connectors having a similar female snap ring to that of ring 27 for connecting to coupler means 20 may be interchanged onto the burr depending on the particular occasion or whim of the person wearing the decorative connector.

Figure 7:
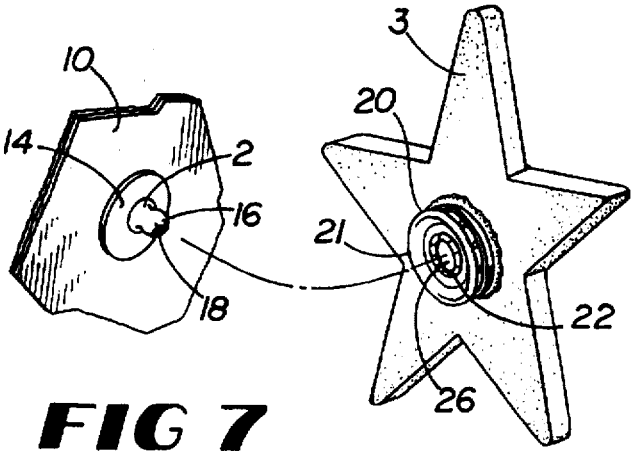
FIG. 7 is a perspective view of an embodiment of the present invention illustrating a detached decorative connector having a coupler means attached to the connector and a clothing burr where the coupler means is secured.

FIG. 7 illustrates another preferred embodiment of the present invention where decorative connector 3 is adhesively joined to coupler means 20. The connector 3 can then be attached to the burr 2 of clothing 10 by pressing decorative connector 3 over male member 16 securing the male member in recess 26 of inner snap element 21. Although this embodiment is illustrative of the coupler means being attached to the decorative connector, various forms of securement of the coupler means to the connector are contemplated. Examples of various means for joining the coupler means and the connector include adhesives, soutering, mechanical fastening means including magnetic fastening or formed integration of the coupler means with the decorative connector itself. Additionally, the mating surfaces of a hook and pride fastener may be used. For example, one surface may be provided across coupler 20 and another surface mounted to the rear of the decorative element. Positioning the two surfaces together causes the decorative element to remain attached to the surface mounted to coupler 20. Preferably, the coupler is soutered to the decorative connector.

Figure 8:
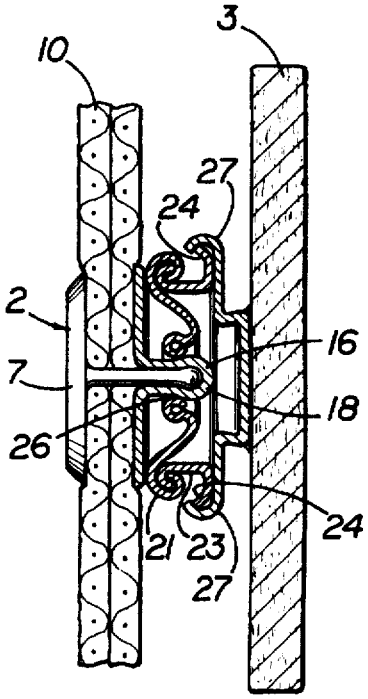
FIG. 8 is a side view of an embodiment of the present invention illustrating a decorative connector in the attached state.

FIG. 8 illustrates a side view of decorative connector 3 affixed to burr 2 of clothing 10. The burr is shown secured to the article of clothing 10 by securing flange 7 with protrusion 9. The male member 16 is aligned and placed over protrusion 9 through a known riveting process whereby burr 2 is solidly secured to article 10. The affixed decorative connector 3 is attached to burr 2 by coupler means shown generally at 20. The snap head 18 of burr 2 is secured in recess 26 of inner snap element 21. Also illustrated is female snap ring 27 securely attached to the male snap ring 24 of outer snap element 23. In a preferred embodiment of the invention, when decorative connector 3 is detached, coupler 20 remains mounted and secured onto burr 2 ready to receive the next decorative connector.

The foregoing description of the preferred embodiments of the present invention has been presented for purposes of illustration and description. It is not intended to be exhaustive or to limit the invention to the precise form or embodiment disclosed. Obviously many modifications and variations will be apparent to those skilled in the art. The embodiments were chosen and described in order to best explain the principles of the invention and its practical application thereby enabling others skilled in the art to understand the invention for various embodiments and with various modifications as are suited to the particular use contemplated. It is intended therefore that the scope of the invention be defined by the accompanying claims and their equivalents.

What is claimed is:

1. A decorative element and connector for selectively affixing a decorative element to one of a plurality of burrs extending from an article of clothing comprising:

a decorative element; and coupler means being detachably secured to said decorative element and said coupler means consisting solely of an inner snap element and an outer snap element, said inner snap element having a recess adapted to receive one of said burrs extending from an article of clothing so that said coupler means may be selectively coupled to any one of said burrs so that only the coupler means is between the one of said burrs and the decorative element, said coupler means may be used to locate said decorative element at one of said burrs extending from an article of clothing or different decorative elements may be coupled to a single burr without removing said coupler means from the single burr.

2. The decorative connector of claim 1 wherein said coupler means is selectively secured to said decorative element by one of a mechanical means and magnets.

3. The decorative connector of claim 1 wherein said inner and said outer snap elements forming a compound snap interface so that said decorative element may be coupled to an article of clothing by combining said inner snap element and said outer element to form said compound snap interface, placing a male member of a burr in said recess of said inner snap element and selectively securing said decorative element to said outer snap element.

4. The decorative connector of claim 3, said decorative element further comprising:

a female snap ring; and said outer snap dement including a male snap ring so that said female snap ring of said decorative element may be mated with said male snap ring of said outer element to selectively secure said decorative element to said coupler means.

5. The decorative element of claim 4; said female snap ring comprising:

a plurality of radial spring type gripper elements.

6. An article of clothing in combination with a coupler and a decorative element comprising:

an article of clothing having a plurality of burrs extending from said article, each said burr having a flat base and a protrusion extending outwardly from said flat base; and coupler means consisting solely of an inner snap element and an outer snap element said coupler means being adapted to receive any one of said burrs, so that said coupler means may be moved to any one of said burrs in said plurality and detachably securing a decorative element to said article of clothing so that only the coupler means is between the one of said burrs and the decorative element.

7. The article of clothing according to claim 6, said coupler means further comprises:

said inner snap element having a recess for receiving said protrusion of said burr extending from said flat base; and said outer snap element having a male snap ring; and said decorative element having a female snap ring so that said decorative element may be selectively coupled to said coupler means by mating said male snap ring of said outer snap element with said female snap ring of said decorative element.

* * * * *